US007627991B1

(12) United States Patent
Feldhaus

(10) Patent No.: US 7,627,991 B1
(45) Date of Patent: Dec. 8, 2009

(54) GUTTER DEBRIS COVER

(76) Inventor: Daniel E. Feldhaus, 1285 W. County Rd 750 North, Delphi, IN (US) 46923

( * ) Notice: Subject to any disclaimer, the term of this patent is extended or adjusted under 35 U.S.C. 154(b) by 172 days.

(21) Appl. No.: 11/637,337

(22) Filed: Dec. 12, 2006

Related U.S. Application Data

(60) Provisional application No. 60/779,831, filed on Mar. 7, 2006.

(51) Int. Cl.
*E04D 13/00* (2006.01)

(52) U.S. Cl. ..... 52/12; 52/11; 210/155

(58) Field of Classification Search ..... 52/11, 52/12; 220/474, 155, 163; D23/267; 4/510; 404/4

See application file for complete search history.

(56) References Cited

U.S. PATENT DOCUMENTS

| | | | | | |
|---|---|---|---|---|---|
| 2,209,741 | A | * | 7/1940 | Sullivan et al. | 210/474 |
| 2,672,832 | A | * | 3/1954 | Goetz | 52/12 |
| 4,815,888 | A | * | 3/1989 | Stegmeier | 404/4 |
| 4,941,299 | A | * | 7/1990 | Sweers | 52/12 |
| 4,959,932 | A | * | 10/1990 | Pfeifer | 52/12 |
| 5,271,192 | A | * | 12/1993 | Nothum et al. | 52/12 |
| 5,406,754 | A | * | 4/1995 | Cosby | 52/12 |
| 5,956,904 | A | * | 9/1999 | Gentry | 52/12 |
| 2001/0037610 | A1 | * | 11/2001 | Davis | 52/12 |
| 2004/0000098 | A1 | * | 1/2004 | Knudson | 52/12 |
| 2006/0053697 | A1 | * | 3/2006 | Higginbotham | 52/12 |
| 2006/0123710 | A1 | * | 6/2006 | Lenney et al. | 52/12 |
| 2006/0230687 | A1 | * | 10/2006 | Ealer, Sr. | 52/12 |
| 2007/0017175 | A1 | * | 1/2007 | Tamlyn | 52/302.4 |

FOREIGN PATENT DOCUMENTS

| | | | | |
|---|---|---|---|---|
| DE | 3804541 | A1 | * | 7/1988 |
| JP | 10-8661 | | * | 1/1998 |
| JP | 2001-342721 | A | * | 12/2001 |

* cited by examiner

*Primary Examiner*—Robert J Canfield
*Assistant Examiner*—Christine T Cajilig
(74) *Attorney, Agent, or Firm*—Barnes & Thornburg LLP

(57) ABSTRACT

A gutter debris cover having an elongated screening element with openings for fluid flow therethrough. Attachment members are provided on either edge of the screening element, with each attachment member having a cross-sectional configuration. In one form, the cross-sectional configurations are mirror images of one another and are generally recurved to connect to gutter elements. In another form of the invention, only the second or rear cross sectional configuration is recurved.

14 Claims, 4 Drawing Sheets

GUTTER DEBRIS COVER

RELATED APPLICATION

This application is the non-provisional filing of Provisional Application Ser. No. 60/779,831, filed Mar. 7, 2006

BACKGROUND OF THE INVENTION

This invention relates to gutters for roofs and other structures, and in particular to a gutter debris cover formed to allow water to pass therethrough but which can be readily and easily installed in an open-mouth gutter.

Gutters are common structures found along roof eaves for water diversion, but open-mouth gutters have a tendency to become clogged because of debris captured in the gutter as time passes. Therefore, various types of devices have been developed over the years to try to prevent accumulation of debris in a gutter.

U.S. Pat. No. 5,893,240 is directed to a simple screen for providing a covering for a gutter. An earlier version of that screen is found in U.S. Pat. No. 4,907,381.

A more sophisticated version of a screen-type gutter cover is disclosed in U.S. Pat. No. 5,956,904. The structure of the '904 patent is a screen comprising first and second screens, with the top screen having smaller mesh openings than the lower screen.

U.S. Pat. No. 6,151,837 discloses a more rigid type of gutter cover having perforated openings in an otherwise sheet metal surface. It attaches to the front gutter flange with a forwardly-opening groove, and is either tucked under roof shingles or force-fit into the gutter in bowed configuration.

SUMMARY OF THE INVENTION

The present invention is directed to a gutter debris cover comprising an elongated screening element having openings therein for fluid flow therethrough, with the screening element having first and second side edges. A first attachment member extends from and along at least a portion of the first side edge, with the first attachment member having a first cross-sectional configuration. A second attachment member extends from and along at least a portion of the second side edge, with the second attachment member having a second cross-sectional configuration. In one form of the invention, the first and second cross-sectional configurations are mirror images of another. In this form of the invention, the cross-sectional configurations are preferably recurved. In another form of the invention, only the second cross-sectional configuration is recurved, with the first cross-sectional configuration being any appropriate means for securing to a gutter lip.

In accordance with the preferred form of the invention, the openings in the elongated screening element comprise an open mesh structure. The screening element can be a single layer, or can comprise first and second elongated screening elements with the second elongated screening element overlying the first. Preferably the second elongated screening element has an open mesh structure having openings smaller than those of the first elongated screening element.

At least the second cross-sectional configuration is recurved. The recurved structure can be any form sufficient to lodge the debris cover in place. For example, only, the structure be Z-shaped, V-shaped, W-shaped, U-shaped (or C-shaped), or any other appropriate configuration to cause it to lodge in place.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
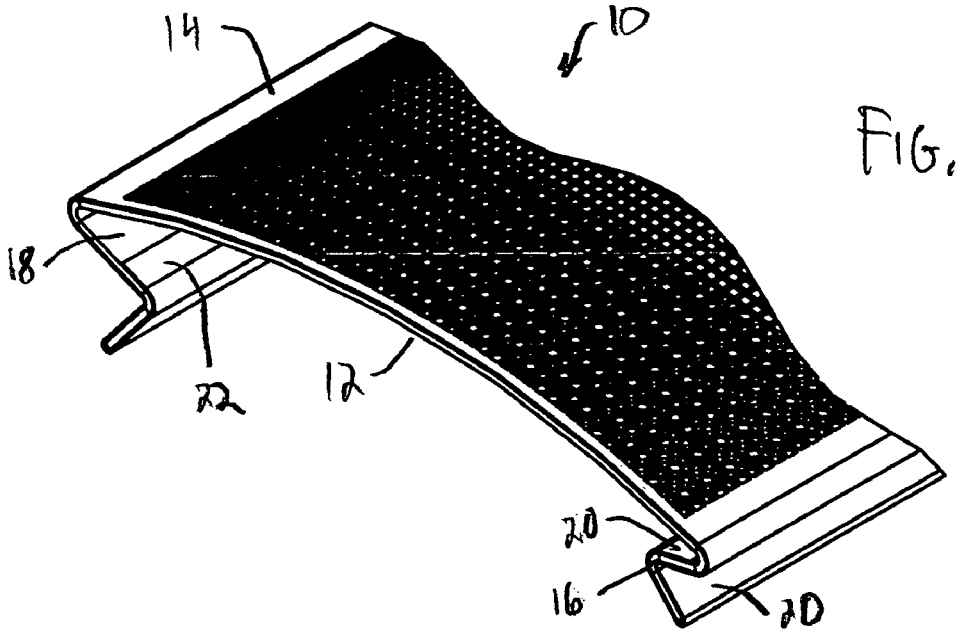
FIG. 1 is an isometric view of one form of the invention, having first and second screening elements.
Figure 2:
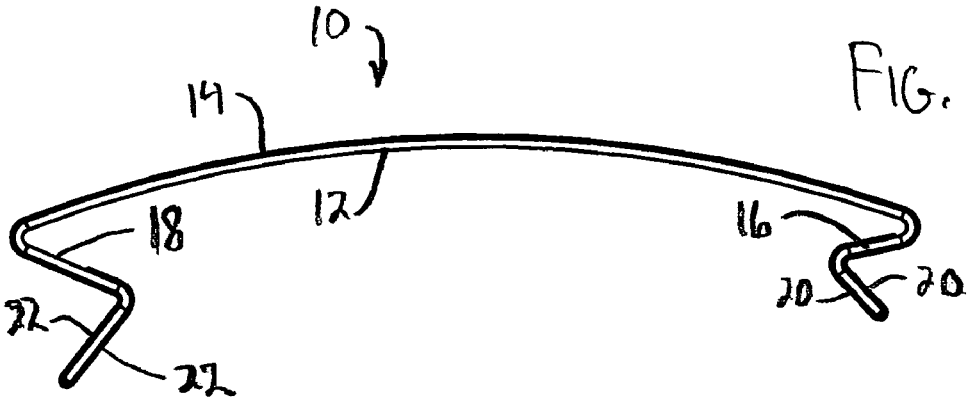
FIG. 2 is a side elevational illustration thereof.

A first form of a gutter debris cover according to the invention is shown generally at 10 in FIGS. 1 and 2. The gutter debris cover 10 comprises two components, a first elongated screening element 12 overlain by a second elongated screening element 14.

The first elongated screening element 12 is preferably identical to that shown and described in relation to FIGS. 3 through 6. It comprises a first attachment member 16 extending from and along at least a portion of one side edge of the screening element 12 and a second attachment member 18 extending from and along at least a portion of the opposite side edge of the screening element 12. As illustrated, the attachment members 16 and 18 have a generally Z-shaped configuration for attachment to a gutter, although the cross-sectional configuration illustrated is simply one of several possible cross-sectional configurations which could secure the elongated screening element 12 to a gutter or the like.

Preferably, the first and second screening elements 12 and 14 are formed of metal, and are bent to the configurations shown in FIGS. 1 and 2. The screening element 12 has a series of openings comprising an open mesh structure (see FIG. 3 onward), and the second elongated screening element 14 similarly has an open mesh, but having openings that are smaller in dimension than the openings of the first elongated screening element 12, in order to prevent fine debris from entering a gutter.

The second elongated screening element 14 overlies the first elongated screening element 12 and typically can be of a thinner, and therefore more pliable material. As best shown in FIG. 2, the second elongated screening element 14 has a first attachment member 20, which confirms to, and extends around, the first attachment member 16. Similarly, the second elongated screening element 14 has a second attachment member 22 which extends around, and conforms to, the second attachment member 18. With the attachment members 20 and 22 formed as shown and wrapped around the corresponding first attachment member 16 and second attachment member 18, the second elongated screening element 14 is held in place on the first elongated screening element 12 without the need of any fasteners, adhesives, or any other means of joining the two structures together. Alternatively, there can be other means of joining the first elongated screening element 12 to the second elongated screening element 14, such as fasteners, adhesives, welding and the like. In that instance, if a robust joining of the second elongated screening element 14 to the first elongated screening element 12 occurs, the first and second attachment members 20 and 22 may be unnecessary and can be eliminated.

As illustrated, in the preferred form of the invention, the first attachment member 16 and the second attachment member 18 are essentially mirror images of one another, although one or the other can be larger for appropriate attachment to a gutter. Although having the first attachment member 16 and second attachment member 18 configured as shown is preferred in order to avoid the need of any fasteners for installing the debris cover 10 in place, alternatively the recurved shape of the first attachment member 16 can be omitted and the first attachment member simply extend outwardly so that it can be attached to the lip of a gutter, such as with fasteners of any kind, adhesives, or welding. The second attachment member 18, however, is preferred to remain in a recurved bend, as illustrated, in order to secure the debris cover 10 to gutter fasteners, as explained in greater detail below.

While it is preferred that the attachment members 16 and 18 be continuous in the elongated direction of the screening element 12, in some instances the attachment members 16 and 18 can be formed intermittently along the length of the screening element 12 and the debris cover 10 can still be secured in place. Other configurations will become apparent to those skilled in the art.

While in many instances it is preferred to have the gutter debris cover 10 as combination of the two screening elements 12 and 14, in some instances simply the first elongated screening element 12 is sufficient, and that is illustrated as the gutter debris cover 10' in FIGS. 3 through 6. Elements remaining the same as the first embodiment of FIGS. 1 and 2 maintain the same reference characters.

Figure 3:
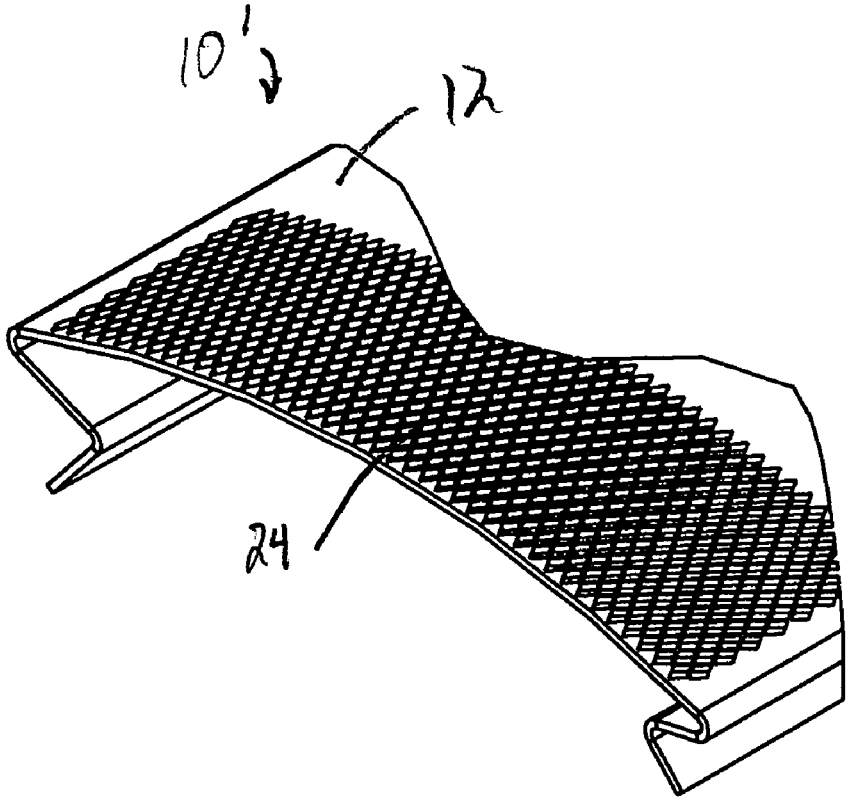
FIG. 3 is an isometric view similar to that of FIG. 1, but of a single screening element.
Figure 4:
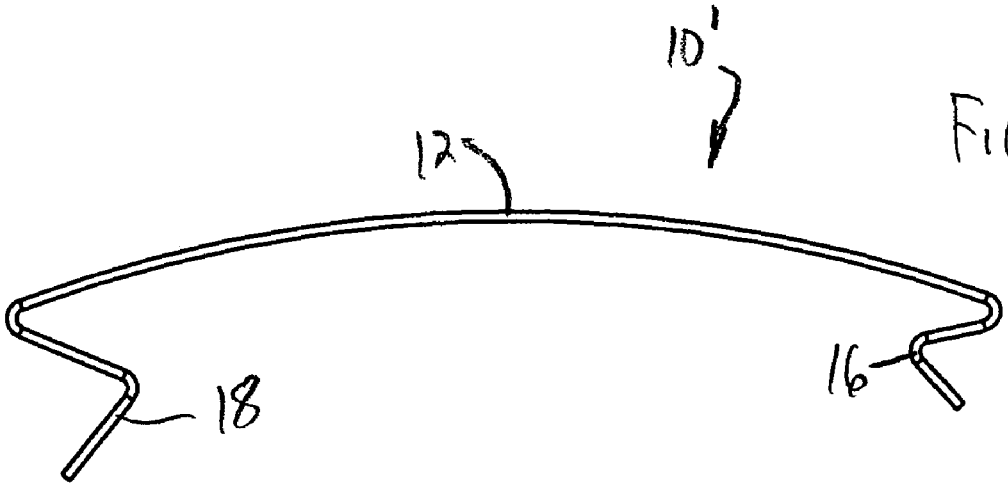
FIG. 4 is a side elevational illustration thereof.
Figure 5:
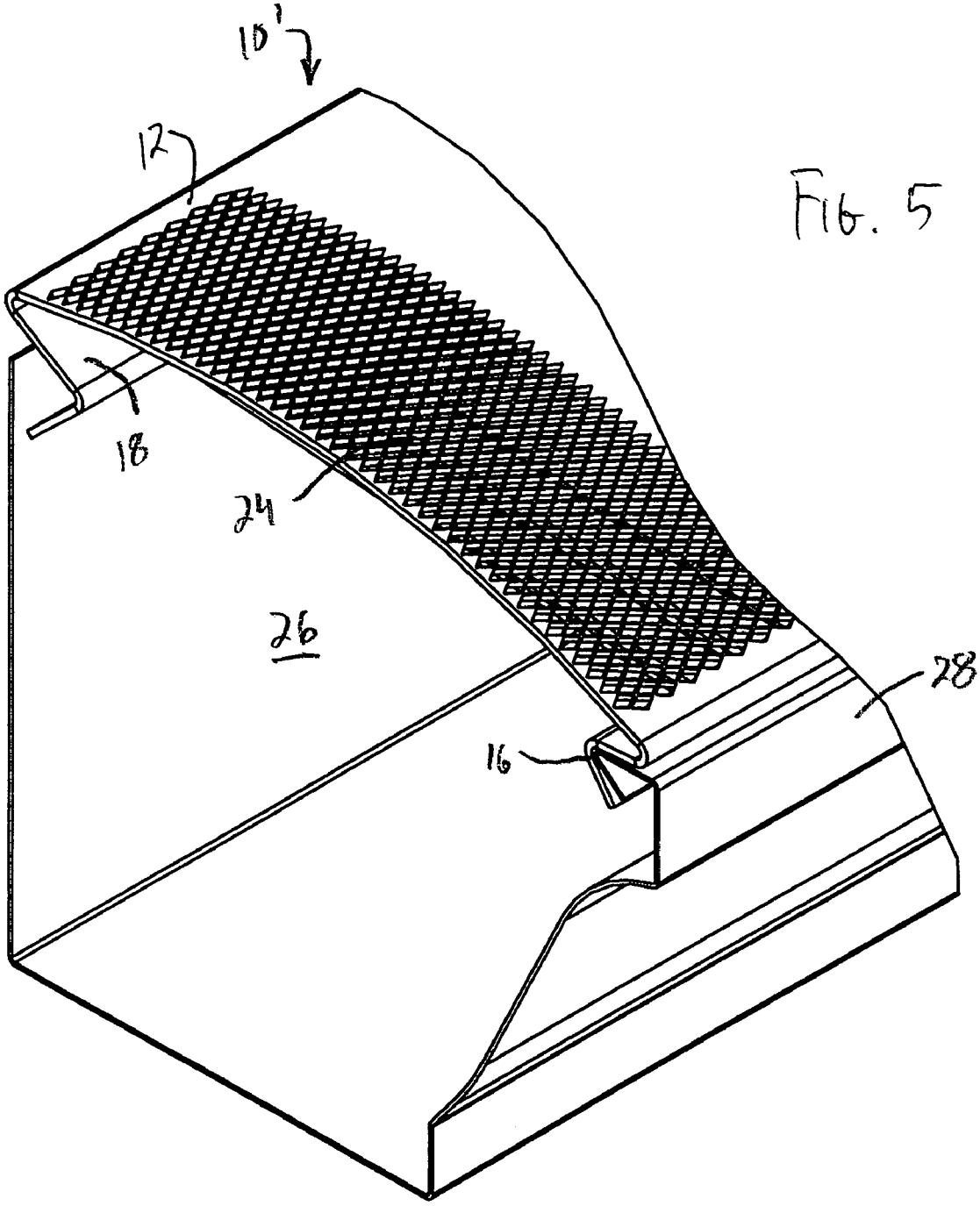
FIG. 5 is an isometric view of the debris cover of FIGS. 3 and 4 when installed in a gutter.

As shown in FIGS. 3 and 5, the elongated screening element 12 has a series of openings 24 therein for fluid flow therethrough. As explained above, the openings 24 are more coarse and of a greater dimension than the openings in the second elongated screening element 14 of FIGS. 1 and 2, although any opening configuration can be employed so long as there is adequate fluid flow therethrough.

Figure 6:
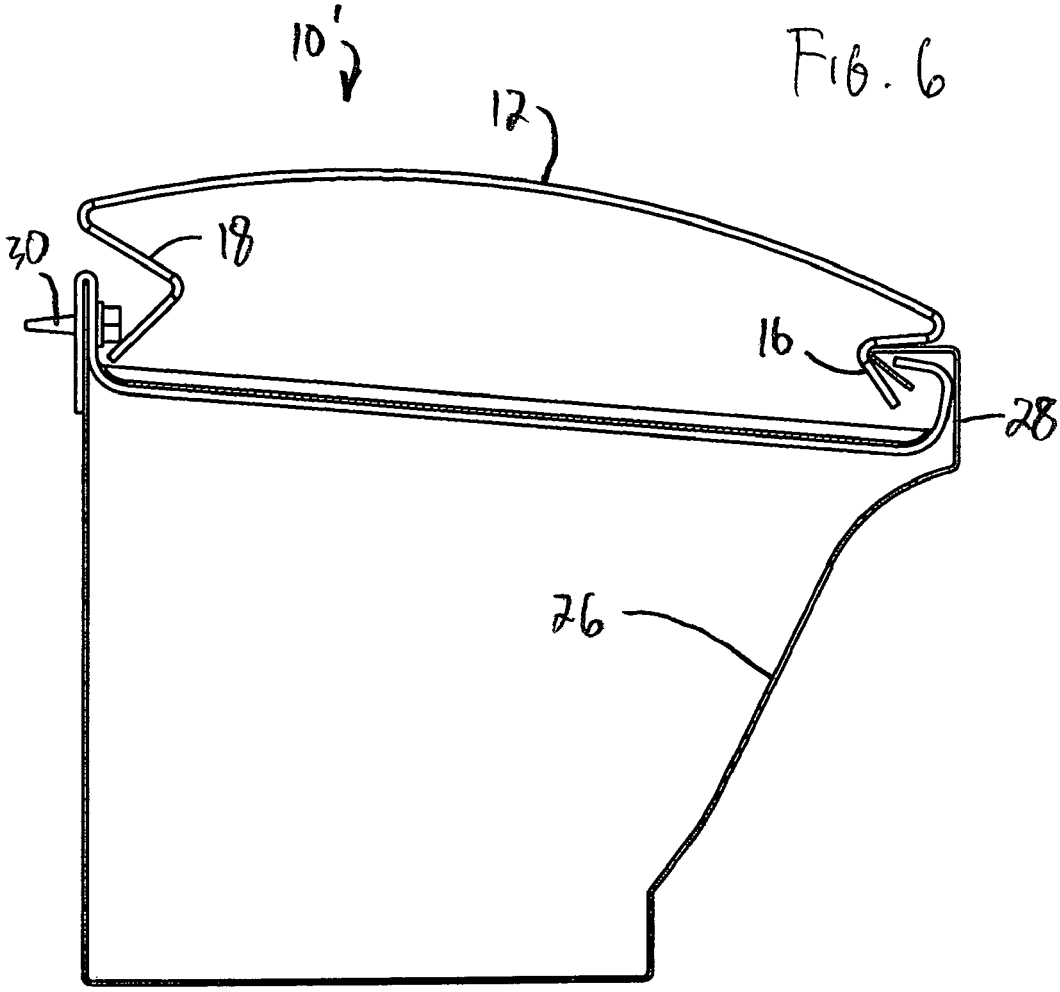
FIG. 6 is a side elevational illustration of what is shown in FIG. 5.

FIGS. 5 and 6 illustrate the debris cover 10' installed in a gutter 26. Installation of the debris cover 10 of FIGS. 1 and 2 would be identical. As illustrated, the first attachment member 16 engages the front lip 28 of the gutter 26, and the second attachment member 18 engages beneath hanger screws 30 used for securing the gutter 26 to building fascia and the like (not illustrated). While the debris covers 10 and 10' are normally formed so that their elongated draining surface is generally planar, when installed in the gutter 26 as illustrated, the debris covers 10 and 10' are installed under slight compression to bow them upwardly as shown in FIGS. 5 and 6, not only to assure a robust connection to the gutter 26, but also to form an upward bow so that debris falls away from the debris cover 10 or 10' and does not accumulate in any depressions thereon. The gutter debris cover according to the invention provides a versatile means of covering a gutter 26 to prevent accumulation of debris therein.

The openings in the first and second elongated screening elements 12 and 14 extend throughout the lengths of the screening elements, but for the sake of illustration, are not shown extending that far. Indeed, the first elongated screening element can be formed entirely of the diamond-shaped mesh illustrated in FIGS. 3 through 6, including the attachment members 16 and 18. Alternatively, only the planar portion of the debris cover can be perforated, with the attachment members being solid.

Both elements 12 and 14 are preferably metal, although either or both can be made of different materials so long as they exhibit the properties described herein. For example, the screening element 14 could be plastic and appropriately affixed to the screening element 12.

Various changes can be made to the invention without departing from the spirit thereof or scope of the following claims.

What is claimed is:

1. A gutter debris cover, comprising a. an elongated screening element shaped to be installed in a substantially horizontal configuration across a top opening of a gutter, said screening element having openings therein for fluid flow downwardly therethrough, said screening element having first and second side edges, b. an integral first attachment member extending from and along at least a portion of said first side edge, said first attachment member having a first cross-sectional configuration, including a first leg extending downwardly and linearly inwardly beneath said screening element and a second leg extending downwardly and linearly outwardly from said first leg, c. an integral second attachment member extending from and along at least a portion of said second side edge, said second attachment member having a second cross-sectional configuration, including a third leg extending downwardly and linearly inwardly from said second side edge and spaced beneath said screening element a first distance and a fourth leg extending downwardly and linearly outwardly from said third leg, said fourth leg extending a second distance outwardly substantially equal to said first distance, and d. said second cross-sectional configuration being oriented in an opposite spatial orientation said first cross-sectional configuration.

2. The gutter debris cover according to claim 1 in which said openings comprise an open mesh structure.

3. The gutter debris cover according to claim 2 including a second elongated screening element overlying said first elongated screening element.

4. The gutter debris cover according to claim 3 in which said second elongated screening element has an open mesh structure having openings smaller than the openings of said first elongated screening element.

5. The gutter debris cover according to claim 1 including a second elongated screening element overlying said first elongated screening element.

6. The gutter debris cover according to claim 5 in which said second elongated screening element has an open mesh structure having openings smaller than the openings of said first elongated screening element.

7. The gutter debris cover according to claim 1 in which said first cross-sectional configuration is generally recurved.

8. A gutter debris cover, comprising a. an elongated screening element shaped to be installed in a substantially horizontal configuration across a top opening of a gutter, said screening element having openings therein for fluid flow downwardly therethrough, said screening element having first and second side edges, b. an integral first attachment member extending from and along at least a portion of said first side edge, said first attachment member having a first cross-sectional configuration, including a first leg extending downwardly and linearly inwardly beneath said screening element and a second leg extending downwardly and outwardly from said first leg, c. an integral second attachment member extending from and along at least a portion of said second side edge, said second attachment member having a second cross-sectional configuration, including a third leg extending downwardly and linearly inwardly from said second side edge and spaced beneath said screening element a first distance and a fourth leg extending downwardly and linearly outwardly from said third leg, said fourth leg extending a second distance outwardly substantially equal to said first distance and d. said second cross-sectional configuration being recurved.

9. The gutter debris cover according to claim 8 in which said openings comprise an open mesh structure.

10. The gutter debris cover according to claim 9 including a second elongated screening element overlying said first elongated screening element.

11. The gutter debris cover according to claim 10 in which said second elongated screening element has an open mesh structure having openings smaller than the openings of said first elongated screening element.

12. The gutter debris cover according to claim 8 including a second elongated screening element overlying said first elongated screening element.

13. The gutter debris cover according to claim 12 in which said second elongated screening element has an open mesh structure having openings smaller than the openings of said first elongated screening element.

14. The gutter debris cover according to claim 8 in which said first cross-sectional configuration is generally recurved.

* * * * *